United States Patent [19]

Shima et al.

[11] 4,026,973

[45] May 31, 1977

[54] PROCESS FOR PREPARING HEAT-RESISTANT AROMATIC POLYESTER FILAMENTS

[75] Inventors: Takeo Shima; Seiichi Yamashiro; Masao Yoshimura; Takayuki Kobayashi; Takatoshi Kuratsuji; Hiroo Inata, all of Iwakuni, Japan

[73] Assignee: Teijin Limited, Osaka, Japan

[22] Filed: Aug. 1, 1975

[21] Appl. No.: 601,232

Related U.S. Application Data

[60] Continuation of Ser. No. 393,300, Aug. 31, 1973, abandoned, which is a division of Ser. No. 170,312, Aug. 9, 1971, abandoned.

[52] U.S. Cl. ..... 264/235; 264/290 T; 264/342 RE; 264/346; 260/75 T

[51] Int. Cl.[2] ..... B29C 25/00

[58] Field of Search ..... 264/210 F, 342 RE, 235, 264/290 T, 346; 260/75 R, 75 T

[56] References Cited

UNITED STATES PATENTS

| | | | |
|---|---|---|---|
| 3,413,797 | 12/1968 | Chapman | 57/140 |
| 3,564,835 | 2/1971 | Keefe et al. | 57/140 |
| 3,616,832 | 11/1971 | Shima et al. | 264/210 F |
| 3,634,580 | 1/1972 | Wafase et al. | 264/342 |
| 3,683,060 | 8/1972 | Tanabe et al. | 264/289 |
| 3,739,056 | 6/1973 | Evans et al. | 264/290 T |

FOREIGN PATENTS OR APPLICATIONS

| | | | |
|---|---|---|---|
| 47-49769 | 12/1972 | Japan | 264/342 RE |

*Primary Examiner*—Jay H. Woo
*Attorney, Agent, or Firm*—Sherman & Shalloway

[57] ABSTRACT

Heat-resistant aromatic polyester filaments having heretofore unknown physical properties and a combination of excellent heat resistance and mechanical strength, which (1) is composed of an aromatic polyester in which at least 90 mole % of the structural units are ethylene-2,6-naphthalate units, (2) has a melting point at a constant length (Tm;°C.) of at least 287° C., (3) has a density (d)(g/cm$^3$) of at least 1.370, (4) is insoluble in a phenol/orthodichlorobenzene mixed solvent (mixing ratio = 6/4 on the weight basis) at 160° C. and (5) meets the requirements expressed by the following formulae $$L(Tm - 280) = 400 \quad \text{(I)}$$
$$\Delta n(d - 1.350) = 70 \times 10^{-3} \quad \text{(II)}$$
$$L = \lambda K/(B-b)\cos\theta \quad \text{(III)}$$

and the process for the preparation thereof.

11 Claims, No Drawings

PROCESS FOR PREPARING HEAT-RESISTANT AROMATIC POLYESTER FILAMENTS

This is a continuation of application Ser. No. 393,300, filed Aug. 31, 1973, which is in turn a division of application Ser. No. 170,312, filed Aug. 9, 1971, both now abandoned.

This invention relates to heat-resistant aromatic polyester filaments which can be utilized with great advantages in various fields where a high heat resistance is required and have heretofore unknown physical properties and including a combination of an excellent heat resistance and a mechanical strength applicable to practical use as filaments, and to a process for the preparation of such heat-resistant aromaic polyester filaments.

More specifically, the invention relates to a heat-resistant polyester filament which (1) is composed of an aromatic polyester in which at least 90 mole % of the structural units are ethylene-2,6-naphthalate units, (2) has a melting point at a constant length (Tm;° C.) of at least 287° C., (3) has a density (d) (g/cm$^3$) of at least 1.370, (4) is insoluble in a phenol/ortho-dichlorobenzene mixed solvent (mixing ration = 6/4 on the weight basis) at 160° C. and (5) meets the requirements expressed by the following formulae $$L(Tm - 280) \geqq 400 \quad \text{(I)}$$
$$\Delta n(d-1.350) \geqq 70 \times 10^{-3} \quad \text{(II)}$$

wherein L is a value indicating the crystal size of the aromatic polyester of the filament in the direction almost vertical to the filament axis, such L value being expressed by the equation $$L = \lambda K/(B-b) \cos\theta \quad \text{(III)}$$

in which B is a (010) diffraction peak width in radian unit when the diffraction intensity is (It + Iam) /2 where It is a diffraction intensity at (010) peak position and Iam is a meridional X-ray diffraction intensity at Bragg's reflection angle $2\theta$=15.6°, $\theta$ is the value expressed by the above equation of the reflection angle, $b$ is 0.00204 radian, K is 0.94 and $\lambda$ is 1.542$\Delta$ $\alpha n$ denotes the value of the birefringence of the filament determined by the retardation technique using $\alpha$-bromonaphthalene as a dipping liquid and a Berek Compensator; Tm is the absolute value of the melting point (° C.) of the filament measured while the filament is held at a constant length; and d is the absolute value of the density (g/cm$^3$) of the filament.

Recently, the demand has been increased for synthetic fibers applicable for uses under severe high temperature conditions in various fields such as of clothings and industrial fabrics.

As fibers meeting such demand, fibers or filaments prepared from heat-resistant polymers such as polytetrafluoroethylenes, polybenzimidazoles, poly-m-phenylene phthalamides, and polyamides have been developed. However, these fibers or filaments are defective or insufficient in some or all of the following points; namely the preparation of the starting polymer is very troublesome; the spinning of the starting polymers is troublesome and difficult and special, commercially disadvantageous equipment is required for the spinning of starting polymers; the resulting fibers or filaments are insufficient in properties required of industrial fibers, for instance, high mechanical strength and low water absorption, and therefore, their application ranges are exremely limited; and the resulting fibers or filaments fail to have, in combination, an excellent heat resistance and a mechanical strength applicable to practical use as filaments or fibers.

Although more than 20 years have passed since it was known from the specification of British Patent No. 604 ,073 that polyethylene-2,6-naphthalate is a orientable and crystalline polymer capable of being shaped into filaments or films, no proposal has been made as to a method providing filaments overcoming the abovementioned short-comings with use of this polymer.

The specification of the above British Patent teaches that a filament can be formed from the highly polymeric linear polyester disclosed in the specification by extrusion or by drawing from the melt directly after the completion of the heating or after re-melting and that the filament can be cold-drawn to as much as several times its original length. However, the specification does not make any mention as to the post heat treatment of the obtained filament or changes of the properties of the filament caused by the post heat treatment.

With regard to polyethylene-2,6-naphthalate film, the specification of U.S. Pat. No. 3,501,344 proposes a magnetic recording tape supported on polyethylene-2,6-naphthalate. According to this proposal, a film of polyethylene-2,6-naphthalate biaxially oriented by the axial stretching is subjected to a heat-setting or cyrstallizing treatment under restraint against shrinkage at a temperature usually above 120° C. and up to about 250° C., or more in some case, preferably 200°–240° C. The heat set film can then be heat-relaxed within the same temperature range without restraint against shrinkage. It is stated that the density of the resulting film of polyethylene-2,6-naphthalate is about 1.354. However, the specification of such U.S. Patent does not give any anticipation leading those skilled in the art to polyethylene-2,6-naphthalate films having a density much higher than about 1.354, for instance a density of 1.370 or more, or to means for providing polyethylene-2,6-naphthalate having such a high density as 1.370 or more. Further, the specification of said U.S. Pat. No. is completely silent on means for obtaining filaments of polyethylene-2,6-naphthalate of this invention which have heretofore unknown physical properties, which will be detailed below.

Also a process has been proposed to work up aromatic polyester filaments, especially polyethylene terephthalate filaments, in a finished salable form by one continuous operation (U.S. Pat. No. 3,166,886). The essential feature of this process resides in a combination of the steps of twisting stretched polyethylene terephthalate filaments to produce a yarn, passing the yarn thrugh a bath consisting of a member selected from the group consisting of a solution, a dispersion and an emulsion of at least one substance boiling at a temperature within the range of 120° C. and 350° C., feeding the yarn to two rotatable means on each of which the yarn is wrapped several times, the first rotatable means being electrically heated, heating the yarn between the rotatable means on all sides and uniformly to a temperature within the range of 220° C. to 350° C. for 0.1 to 5 seconds, simultaneously allowing an adjustable shrinkage of the yarn of 5 to 35 % and finally winding up the yarn. However, the specification of such U.S. patent gives no mention at all to polyethylene-2,6-naphthalate, still less critical features for obtaining polyethylene-2,6-naphthalate filaments of this invention having novel physical properties.

In the specification of Shima et al. U.S. patent application Ser. No. 887,237 of the same assignee as this invention, rubber articles reinforced with filaments are mentioned and as the reinforcing filaments of polyethylene-2,6-naphthalate are exemplified. The above specification, however, is quite silent on the post heat treatment of the heat-stretched filaments, and it does not give any anticipation leading those skilled in the art to polyethylene-2,6-naphthalate filaments of this invention having novel physical properties nor suggest any possibility of such novel properties being imparted to filaments of polyethylene-2,6-naphthalate.

As a result of research made on the post heat treatment of polyethylene-2,6-naphthaltate filaments, it has now been found that polyethylene-2,6-naphthalate filaments having novel physical properties that cannot be possessed by any known polyethylene-2,6-naphthalate filaments can be obtained by subjecting stretched polyethylene-2,6-naphthalate filaments having a birefringence of at least 0.27, preferably 0.3 or more, to a first post heat treatment at a temperature within a specific range, and subjecting the filaments to a second post heat treatment at a temperature higher than the temperature adopted at the first post heat treatment in a manner such that the heat treatment temperature and time at the second post heat treatment will satisfy specific conditions.

It has also been found that in case either of the first post heat treatment and the second post heat treatment is omitted, the novel properties intended in this invention cannot be imparted to filaments and that in case the heat treatment temerature and time do not satisfy the above specific conditions at the second post heat treatment, polyethylene-2,6-naphthalate filaments having novel physical properties cannot be obtained.

It has also been found that the polyethylene-2,6-naphthalate filaments having novel properties possess, in combination, highly improved heat resistance and good mechanical strength applicable to practical use, which is generally incompatible with high heat resistance and that they can be conveniently utilized for various applications in broad ranges.

Accordingly, an object of this invention is to provide polyethylene-2,6-naphthlate filaments having novel physical properties.

Another object of this invention is to provide a process for the preparation of such polyethylene-2,6-naphthalate filaments.

Other objects and advantages of this invention will be apparent from the description given hereinbelow.

In order to obtain polyethylene-2,6-naphthalate filaments of this invention it is essential that stretched polyester filaments having a birefringence of at least 0.27 and being composed of an aromatic polyester in which at least 90 mole % of the structural units are ethylene-2,6-naphthalate unis, should be subjected to a first post heat treatment at temperatures of 160° C. or higher and below 250° C. and then the filaments should be subjected to a second post heat treatment at temperatures ranging from 250° C. to 290° C. under such conditions that the total ($\Sigma R$) of the values E expressed by the following equation:

$$E = t \times 4.3^{(T-250)}/10$$

wherein T indicates the heat treatment temperature (° C.) and $t$ denotes the period of time (hour) during which the heat treatment is conducted at T° C., will be at least 1.

Either the first post heat treatment or the second post heat treatment may be conducted under conditions permitting a shrinkage or elongation by not greater than 15 % of the original length of the stretched and oriented polyester filaments. Namely, the first or second post heat treatment may be conducted under conditions permitting a dimension change (length change) in the polyester filaments within a range of from minus 15 % to plus 15 %, preferably from minus 10 % to plus 10 %. It is preferred that either the first post heat treatment or the second post heat treatment is perfored under conditions making the filament length constant or under conditions limiting the filament shrinkage or elongation to not greater than 10 %, especially less than 5 %, of the original filament length. In case the first or second post heat treatment is conducted under conditons permitting an excessive elongation, a tendency appears that yarns are readily broken during the treatment. Further, if the first or second post heat treatment is carried out under conditions permitting an excessive shrinkage, a tendency appears that mechanical properties of the filaments are lowered. Accordingly, it is preferred that the first and second post heat treatments are conducted under the above-mentioned conditions.

As the polyethylene-2,6-naphthalate to be used as the base polymer in this invention, any polymer in which at least 90 mole % of the structural units are ethylene-2,6-naphthaltate units may be employed. Accordingly, the term 37 polyethylene-2,6-naphthalate" used in the present specification means not only a hemopolymer of ethylene-2,6-naphthalate but also a polyethylene-2,6-naphthalate modified with not more than 10 mole %, preferably, less than 5 mole %, of a comonomer or modifier. Since filaments of polyethylene-2,6-naphthalate modified with 10 mole %, or more of a comoner or modifier cannot be converted to filaments having novel properties intended in this invention, such modified polymer cannot be used in this invention.

In general, polyethylene-2,6-naphthalate is prepared by reacting naphthalene-2,6-dicarboxylic acid or its functional derivative with ethylene glycol or its functional derivative in the presence of a catalyst. Reaction conditions and operation procedures have been known in the art and are introduced in, for instance, the above-mentioned specificatons. When a comonomer or modifer is used in an amount of not more than 10 mole %, prior to completion of the reaction of forming polyethylene-2,6-naphthalate, one or more suitable comonomers or modifiers are added to the polymerization system and then the reaction is completed to form a copolyester or mixed polyester.

As such comonomer or modifer, comounds having divalent, ester-forming, functional groups, for instance, dicaraboxylic acids such as oxalic acid, adipic acid, phthalic acid, isophthalic acid, terephthalic acid, naphthalne-2,7-dicarboxylic acid, succinic acid, diphenyl ether dicarboxylic acid and lower alkyl esters of these dicarboxylic acids; hydroxycarboxylic acids such as p-hydroxybenzoic acid and p-hydroxyethoxybenzoic acid, and lower alkyl esters of these hydroxycarboxylic acids; and dihyric alcohols such as propylene glycol and trimethylene glycol may be used. Polyethylene-2,6-naphthalate or its modified polymer may have the terminal hydroxyl and/or carboxyl groups capped with a monofunctional compound such as benzoic acid, benzyloxybenzoic acid and methoxypolyalkylene glycol. It is also possible to use polyethylene-2,6-naphthalate modified with a very small amount of a polyfunctional compound such as glycerin and pentaerythritol to such an extent that the linearity of the polymer is not substantially lost.

It is possible to incorporate into such starting polyethylene-2,6-naphthalate various additives known in the field of the filament manufacture, for example, delustering agents such as titanium dioxide and stabilizers such as phosphoric acid, phosphorous acid are esters thereof.

It is desired that the polyethylene-2,6-naphthalate to be used in this invention has an intrinsic viscosity of not less than 0.35, especially not less than 0.45, more especially 0.55–1.0, because use of a polyethylene-2,6-naphthalate having an intrinsic viscosity of less than 0.35 does not give filaments having novel physical properties intended in this invention. The intrinsic viscosity referred to herein is one determined by the measurement conducted with respect to the polymer in o-chlorophenol at 35° C.

It is essential that the starting polyester filament to be used in this invention should have a birefringence ($\Delta n$) of at least 0.27, preferably at least 0.28, particularly preferably at least 0.3. When a polyester filament having a birefringence below 0.27 is used, polyethylene:2,6-naphthalate filaments having novel physical properties intended in this invention cannot be obtained.

Starting stretched and oriented polyethylene-2,6-naphthalate filaments to be used for obtaining the filaments of this invention are formed from unstretched polyethylene-2,6-naphthalate filaments according to any of the known methods of making stretched filaments. As the starting stretched filaments those preferably employed are oriented filaments obtained by melt-spinning polyethylene-2,6-naphthalate in which at least 90 mole % of the structural units are ethylene-2,6-naphthalate units, preferably at 280°–350° C., and stretching the aspun filament to several times the original length, preferably at a draw ratio of 4 or more, at a temperature exceeding the glass transition temperature of the polymer, preferably at 120°–165° C.

In order to obtain polyethylene-2,6-naphthalate filaments of this invention, such stretched and oriented polyester filaments having a birefringence of at least 0.27 are subjected to the first post heat treatment at temperatures of 160° C. or higher and below 250° C. and are then subjected to the second post heat treatment at temperatures ranging from 250° C to 290° C. As described above, the second post heat treatment should be conducted under such conditions that the total ($\Sigma E$) of the values E, which is a criterion indicating the thermal energy, will be at least 1, preferably at least 1.5. In order to obtain polyethylene-2,6-naphthalate filaments of this invention having novel physical properties, it is necessary that not only the properties of the starting filament and the temperature conditions of the first and second post heat treatments, but also the condition of the total value ($\Sigma E$) of the values E, at the second post treatment, expressed by the quation $$E = t \times 4.3^{(T - 250)/10}$$

wherein $T$ and $t$ are as defined above, should be satisfied.

When the second post heat treatment is conducted at lower temperatures within above-mentioned ranges, longer times are required for the post heat treatment so as to satisfy the above-condition, as compared with the case where the post heat treatment is conducted at higher temeratures within the above ranges. For instance, when the second post heat treatment is conducted at 250° C. for 2 hours, the total of the values E is about 2 and satisfies the condition that the total ($\Sigma E$) should be at least 1. On the other hand, when the first post heat treatment is conducted at 220° C. for 10 seconds and the second post heat treatment is conducted at 250° C. for 30 minutes, although the temperature conditions of the post heat treatments are satisfied, the above condition of $\Sigma E$ is not satisfied, because the value is less than 1, with the result that filaments having novel physical properties intended in this invention cannot be obtained.

Filaments of this invention having novel physical properties can even be obtained by a one-step post heat treatment. However, since such a long treatment time as about one month at 230° C. or 30 hours at 240° C. is required for attaining the desired result, from the economical and industrial viewpoints, it is not preferred to adopt such one-step method. Indeed, the treatment time may be shortened in the one-step method, if the treatment is conducted at a high temperature exceeding 250° C. However, in such case the degree of the heat treatment differs frequently between the surface layer of the filament and the core portion of the filament, or the filament undergoes abruptly a heat treatment of an unduly high temperature, though the melting point of the filament does not rise to a level sufficient to resist such high temperature. Accordingly, in such case the intended polyethylene-2,6-naphthalate having novel physical properties cannot be readily obtained with good reproducibility. Thus, the intended filaments may be obtained by the one-step post heat treatment, if desired, but because of the above difficulties, it is not recommended to adopt such one-step method.

In short, the filaments of this invention may be obtained by any of the following methods, namely a one-step method where the post heat treatment is conducted at a certain temeprature; a multi-staged method where the post heat treatment is preliminary conducted at a relatively low temperature and then the treatment is effected at a higher temperature; and a method where the treatment is carried out while gradually and continuously elevating the treatment temperature. However, the multistaged method is greatly advantageous from the economical and industrial veiwpoints, as compared with the one-step method, and is desired so as to ensure the attainment of novel properties in the produce filaments.

In preparing the polyethylene-2,6-naphthalate filaments of this invention having novel physical properties, it is desired that the first post heat treatment is conducted at a temperature at last about 5° C. than the temperature to be adopted in the second post heat treatment.

When a filament having too great a monofilament denier is subjected to the post heat treatment according to this invention, temperature unevenness is frequently caused in the interior of the filament, which results in the structural unevenness in the product filament. Accordingly, it is desired that the filaments to be subjected to the post heat treatment in this invention have a monofilament denier of 50 or less.

As heating means for the post heat treatment, known heating means such as gaseous heating medium, liquid heating medium, radiation heater, e.g., infra-red heater, electric heater and the like may be adopted. Hot air is most common as the gaseous heating medium, but other heated gases may also be used likewise. As liquid heating medium, heated silicone oil, molten salt, molten metal and heated media of other organic and inorganic compounds may be used. Heating rolls rotating at a peripheral rate which is the same as the running speed of the filament may be used. In this invention, however, use of heating means of a solid material which have a frictional contact with the filaments, such as hot pin and hot plate, is not preferred.

The filament to be subjected to the post heat treatment may take any of the following forms; namely, tows, multifilaments, monofilaments, staple fibers, and yarns, cords, woven fabrics, non-woven fabrics, and knitted fabrics prepared from such tows, multifilaments, monofilaments or staple fibers. It is possible to conduct the first post treatment while the filaments are in the raw material state such as tows and multifilaments and conduct the second post heat treatment after they have been processed into product forms such as woven or knitted fabrics.

The filaments of this invention have properties specified by the requirements (1) to (5) described hereinabove, and polyethylene-2,6-naphthalate filaments having such properties have not been known.

The filaments of this invention have higher degrees of crystalline and orientation than the starting filaments, and are characterized by a density (d) of at least 1.370 and a melting point at a constant length (Tm) of at least 287° C., frequently at least 288° C. Further,in the filaments of this invention, the following relationship between the melting point (Tm) at a constant length and the value L, which will be defined below specifically;

$$L(Tm - 280) \geqq 400$$

is established and another relationship between the birefringence ($\Delta n$) and the density ($d$) (g/cm$^3$);

$$\Delta n(d-1.350) \geqq 7.0 \times 10^{-3}$$

is established.

It is possible to make one of the above parameters great as in this invention by one method or other, but in such case one or more of other parameters are outside the ranges specified in this invention, and accordingly, the filaments intended in this invention cannot be obtained. For instance, when the post heat treatment is conducted for a long period of time under relaxation of more than 20%, the density (d) of the filament may be made greater, but the orientation becomes disordered thereby reducing the value of the birefringence ($\Delta n$) and the melting point at a constant length is not increased. Thus, in such case it is very difficult to obtain the filaments intended in this invention.

The filaments of this invention are insoluble at 160° C. in a phenol/ortho-dichlorobenzene mixed solvent (mixing ratio = 6/4 on the weight basis), which is a good solvent for polyethylene-2,6-naphthalate.

Further, in accordance with this invention, there can be easily provided with good reproducibility polyethylene-2,6-naphthalate filaments having a heat shrinkage (at 155° C. for 5 seconds) of not more than 5% and a thermal deformation temperature exceeding 260° C. For instance, the invention can provide with ease polyethylene-,2,6-naphthalate filaments possessing, in combination, such excellent heat resistance and such filament characteristics, as a tenacity at room temperature (25° C). of more than 3.0 g/d. a Young's modulus of more than 1500 kg/mm$^2$ and a hydrolysis resistance of more than 75%.

We have not completely elucidated the mechanism through which the starting stretched polyethylene-2,6-naphthalate filaments, unlike polyethylene terephthalate or other polyethylene naphthalate filaments, can be given a surprisingly improved heat resistance by the above-mentioned specific post heat treatment, while retaining filament characteristics at high practical levels. But it is construed that not only is the crystallization promoted in the filaments by the post heat treatment but also cross-linkage are formed by the post heat treatment.

polyethylene-2,6-naphthalate filaments of this invention are advantageously used in various fields, for instance, as reinforcing filaments for heat-resistant belts or chords, heat-resistance cloths, heat-resistant clothing fabrics, reinforcing filaments which will take the place of reinforcing glass fibers for plastics for high temperature molding, filter cloths for high temperature waste gases, electrically insulating materials, and the like.

Definitions of specific terms used in this invention will now be described below.

1. L value:

L value indicates the size of the crystal of the filament in the direction almost verical to the filament axis. This value is obtained in accordance with the following equation of P. Scherrer:

$$L = \frac{\lambda K}{(B - b)\cos\theta}$$

wherein $B$ is a (010) diffraction peak width in radian units when the diffraction intensity is (It + Iam)/2 in which It is a diffraction intensity at (010) peak positions, and Iam is a meridonal X-ray diffraction intensity at Bragg's reflection angle $2\theta = 15.6°$ (see Chemicky Prumysl roc 17/42 (1967) cis 2); $b$ is 0.00204 radian; K is 0.94; and $\lambda$ is 1.542.

Instrument used: Geiger Flex D-9C (Rigaku Denki Co., Ltd.) Measurement conditions:

35 KV, 20 mA, CuKaNi-filtered radiation, divergence slit of 0.15 mm, scattering slit of 1°, receiving slit of 0.4 mm 2. Tm (melting point at a constant length):

Tm is the absolute value of the melting point (° C.) measured while the filament length is kept constant. The melting point at a constant length is defined as a temperature (° C.) of a melting peak measured under the following conditions. Seven milligrams of a specimen are fixed to 60 mg of a stainless steel frame to maintain the length of the speciment constant. The frame is then put into an aluminum pan together with 45 mg of silver powder. The measurement is made by means of a Perkin Elmer DSC I type measuring instrument while heating at a rate of 10° C. per minute.

3. $\Delta n$ (birefringence):

$\Delta n$ (birefringence) is a parameter showing the degree of orientation of the molecules in the filament, and is determined by the retardation technique using bromonaphthalene as a dipping liquid and a Berek Compensator (see Modern Textile Microscopy, page 270, Emmot and Company, Limited).

4. *d* (density):

The density d is measured at 23° C. by employing a density-gradient tube of carbon tetrachloride-n-heptane type, the unit bing g/cm³ (see (ASTM D1505).

5. Thermal deformation temperature:

A load corresponding to 2% of the tensile strength at breakage (20° C.) of the sample filament before the post heat treatment is imposed on the post heat treated filament sample, and in this state the atmosphere temperature is raised at a rate 5° C. per minute. The thermal deformation is defined as the temperature at which the filament begins to elongate under the above conditions.

6. Heat shrinkage:

The sample is dipped in silicone oil maintained at 255° C. in the relaxed state for 5 seconds. The heat shrinkage is expressed in terms of the percentile ratio of the amount shrunk of the filament length to the original length.

7. Solvent resistance:

100 Milligrams of a sample filament is dipped in 100 ml of a phenol/ortho-dichlorobenzene mixed solvent at a phenol/orthor-dichlorobenzene weight ratio of 60/40, and the stirring is effected at 160° C. for 30 minutes. The solvent resistance is expressed in terms of the solubility of the sample in the mixed solvent at the above test. The solvent resistance is a parameter showing the chemical resistance, and by the evaluation "insoluble" is meant such solubility that when the sample in the mixed solvent after the above test is filtered with use of a filter of 20–30 $\mu$, the weight of the sample left on the filter is 80% or more of the original weight.

8. Hydrolysis resistance:

The hydrolysis resistance is expressed in terms of the tenacity retention (%) obtained when a sample filament is heated under no tension at 180° C. and at a relative humidity of 100% for 1 hour.

Some embodiments of this invention will now be described by referring to Examples and Comparative Examples.

EXAMPLE 1

A polyethylene-2,6-naphthalate having an intrinsic viscosity of 0.75 was melt-spun, and the spun filament was stretched at a draw ratio of 5.8 at 150° C. and then at a draw ratio of 1.25 at 200° C. As a result, a 1000 de/192 fil polyethylene-2,6-naphthalate filament of a high tenacity and a high Young's modulus was obtained. The intrinsic viscosity and birefringence of the resulting filament is shown in Table 1.

This starting stretched filament was subjected to the post heat treatment under conditions indicated in Table 1 to obtain results shown in Table 2,

EXAMPLE 2–8 AND COMPARATIVE EXAMPLES 1–8

Procedures of Example 1 were repeated while changing the starting filament and post heat treatment conditions as indicated in Table 1. Results are also shown in Table 2.

Table 1

| Example and Comparative Example | Starting Stretched and oriented polyethylene-2,6-naphthalate filament | | | Post heat treatment | | | | | | |
|---|---|---|---|---|---|---|---|---|---|---|
| | | | | 1st step | | | 2nd step | | | |
| | comonomer or modifier | intrinsic viscosity | bire-fringence | tempera-ture (° C) | time | state | tempera-ture (° C) | time | state | E |
| Ex. 1 | — | 0.71 | 0.344 | 210 | 10 sec. | constant length | 255 | 2 hrs. | constant length | 4.15 |
| Comparative Ex. 1 | — | 0.71 | 0.344 | 150 | 10 sec. | constant length | 255 | 2 hrs. | constant length | 4.15 |
| Comparative Ex. 2 | — | 0.71 | 0.344 | 210 | 10 sec. | constant length | 240 | 2 hrs. | constant length | — |
| Comparative Ex. 3 | — | 0.71 | 0.344 | 210 | 10 sec. | constant length | 255 | 20 min. | constant length | 0.69 |
| Ex. 2 | — | 0.68 | 0.347 | 210 | 10 sec. | constant length | 250<br>260<br>270 | 1 hrs.<br>30 min.<br>5 min. | constant length | 4.69 |
| Comparative Ex. 4 | — | 0.68 | 0.347 | 245 | 20 hrs. | constant length | — | — | — | — |
| Comparative Ex. 5 | — | 0.68 | 0.347 | — | — | — | 280 | 5 sec. | constant length | 0.11 |
| Ex. 3 | — | 0.71 | 0.344 | 210 | 10 sec. | constant length | 255 | 2 hrs. | 4.5% elongation | 4.15 |
| Ex. 4 | — | 0.71 | 0.344 | 210 | 10 sec. | constant length | 255 | 2 hrs. | 4.5% shrinkage | 4.15 |
| Ex. 5 | — | 0.68 | 0.303 | 210 | 10 sec. | constant length | 250<br>260<br>270<br>280 | 1 hr.<br>20 min.<br>5 min.<br>10 sec. | constant length | 4.19 |
| Ex. 6 | naphthalene-2,7-dicarboxylic acid (3 mole %) | 0.70 | 0.341 | 210 | 10 | constant | 250 | 2 hrs.<br>30 min. | constant length | 4.15 |
| Ex. 7 | diethylene glycol (3 mole %) | 0.65 | 0.337 | 210 | 10 sec. | constant length | 250<br>260 | 2 hrs.<br>30 min. | constant length | 4.15 |
| Ex. 8 | — | 0.71 | 0.344 | 210 | 10 sec. | constant length | 250 | 4 hrs. | 43% shrinkage | 4.00 |
| Comparative Ex. 6 | diethylene glycol (12 mole %) | 0.67 | 0.334 | 210 | 10 sec. | constant length | 255 | 2 hrs. | constant length | 4.15 |
| Compara- | | | | | | | | | | |

Table 1-continued

| Example and Comparative Example | Starting Stretched and oriented polyethylene-2,6-naphthalate filament | | | Post heat treatment | | | | | | |
|---|---|---|---|---|---|---|---|---|---|---|
| | | | | 1st step | | | 2nd step | | | |
| | comonomer or modifier | intrinsic viscosity | bire-fringence | tempera-ture (° C) | time | state | tempera-ture (° C) | time | state | E |
| tive Ex. 7 | — | 0.68 | 0.260 | 210 | 10 sec. | constant length | 250<br>260 | 2 hrs.<br>30 min. | constant length | 4.15 |
| Comparative Ex. 8 | — | 0.71 | 0.344 | 210 | 10 sec. | constant length | 255 | 2 hrs. | 20% shrinkage | 4.15 |

Table 2

| | melting point at constant length $T_m$ (° C.) | d | solvent resistance | L | Properties of post heat treated filaments | | | | | | | | |
|---|---|---|---|---|---|---|---|---|---|---|---|---|---|
| | | | | | L ($T_m$-280) | n | Δn (d-1,350) | heat shrin-kage (%) | thermal deforma-tion tempera-ture (° C.) | hydro-lysis resis-tant (%) | Young's tena-city (g/d) | modulus (Kg/mm²) | elon-gation (%) |
| Ex. 1 | 290.3 | 1.3725 | insoluble | 61 | 629 | 0.351 | $7.9 \times 10^{-3}$ | 1.0 | 260.5 | 78 | 7.0 | 2220 | 7.6 |
| Comparative Ex. 1 | 287.1 | 1.3695 | soluble | 57 | 405 | 0.348 | $6.8 \times 10^{-3}$ | 4.8 | 259.0 | 72 | 6.8 | 2180 | 7.9 |
| Comparative Ex. 2 | 286.1 | 1.3650 | soluble | 53 | 323 | 0.354 | $5.3 \times 10^{-3}$ | 5.4 | 257.0 | 68 | 9.1 | 2330 | 7.0 |
| Comparative Ex. 3 | 286.1 | 1.3720 | soluble | 65 | 396 | 0.361 | $7.8 \times 10^{-3}$ | 3.1 | 258.5 | 67 | 7.6 | 2190 | 7.9 |
| Ex. 2 | 292.0 | 1.3735 | insoluble | 65 | 780 | 0.361 | $8.5 \times 10^{-3}$ | 0.1 | 265.0 | 80 | 5.5 | 2160 | 6.7 |
| Comparative Ex. 4 | 287.0 | 1.3675 | soluble | 57 | 399 | 0.352 | $6.2 \times 10^{-3}$ | 6.5 | 257.7 | 65 | 7.2 | 2430 | 6.6 |
| Comparative Ex. 5 | (measurements were impossible because of filament breakages) | | | | | | | | | | | | |
| Ex. 3 | 290.3 | 1.3725 | insoluble | 61 | 629 | 0.353 | $7.9 \times 10^{-3}$ | 2.4 | 261.0 | 77 | 7.1 | 2210 | 6.9 |
| Ex. 4 | 289.5 | 1.3730 | insoluble | 65 | 618 | 0.349 | $8.0 \times 10^{-3}$ | 0.8 | 260.3 | 76 | 6.7 | 2180 | 8.2 |
| Ex. 5 | 291.6 | 1.3715 | insoluble | 61 | 708 | 0.325 | $7.0 \times 10^{-3}$ | 0.3 | 262.0 | 80 | 5.0 | 1650 | 9.0 |
| Ex. 6 | 288.0 | 1.3720 | insoluble | 61 | 488 | 0.349 | $7.7 \times 10^{-3}$ | 1.7 | 261.0 | 78 | 6.8 | 2250 | 7.8 |
| Ex. 7 | 287.1 | 1.3715 | insoluble | 61 | 433 | 0.347 | $7.5 \times 10^{-3}$ | 2.1 | 260.2 | 76 | 6.7 | 2170 | 7.9 |
| Ex. 8 | 289.6 | 1.3720 | insoluble | 61 | 586 | 0.349 | $7.7 \times 10^{-3}$ | 2.8 | 260.1 | 76 | 6.8 | 2030 | 8.7 |
| Comparative Ex. 6 | 272.3 | 1.3690 | soluble | 57 | — | 0.341 | $6.5 \times 10^{-3}$ | 5.8 | 257.0 | 65 | 5.2 | 1780 | 8.1 |
| Comparative Ex. 7 | 288.0 | 1.3680 | soluble | 53 | 424 | 0.272 | $4.9 \times 10^{-3}$ | 5.3 | 258.0 | 66 | 4.5 | 1200 | 9.5 |
| Comparative Ex. 8 | 287.0 | 1.3710 | insoluble | 57 | 399 | 0.329 | $6.9 \times 10^{-3}$ | 2.0 | 259.4 | 71 | 6.5 | 2090 | 8.0 |

Note:
In Example 8, the second post heat treatment was conducted after the filament had been woven into a fabric.

What we claim is:

1. A process for the preparation of heat-resistant polyethylene-2,6-naphthalate filaments which comprises subjecting stretched polyethylene-2,6-naphthalate filaments having a birefringence of at least 0.27, an intrinsic viscosity ranging from 0.35 and 1.0, and being composed of at least 90 mol% of ethylene-2,6-naphthalene structural units, to a first post heat treatment at constant length and at temperatures of 160° C. to below 250° C., and then subjecting the filaments to a second post heat treatment wherein elongation or shrinkage is not greater than 5% and at temperatures ranging from 250° C. to 290° C. and having from one to four heating stages, such that the thermal energy vlaue (E) for each particular heating stage satisfies the equation $$E = t \times 4.3^{(T-250)/10}$$

wherein $t$ is the time of the particular heating stage in hours and $T$ is the temperature of the particular heating stage in ° C., with the proviso that the sum of the thermal energy values for all of the heating stages ($\Sigma E$) is at least one.

2. The process of claim 1 wherein the stretched filaments are formed by melt-spinning polyethylene-2,6-naphthalate at a temperature of 280° to 350° C. and stretching the as-spun filaments at a draw ratio of at least 4 and at a temperature of 120° C to 165° C.

3. The process of claim 1 wherein the stretched filaments are held at constant length during the second post heat treatment.

4. The process of claim 1 wherein at least 95 mol% of the filaments are composed of ethylene-2,6-naphthalene structural units.

5. The process of claim 1 wherein the filament's intrinsic viscosity is at least 0.55 and its birefringes is at least 0.3.

6. The process of claim 1 wherein ΣE is at least 1.5.

7. The process of claim 6 wherein ΣE is at least 4.0.

8. The process of claim 1 wherein the first post heat treatment is conducted at a temperature of at least 5° C. lower than the lowest temperatures of the second post heat treatment.

9. The process of claim 1 wherein the total time ($\Sigma t$) for all the heating stages is form about 1 hour 25 minutes to about 4 hours.

10. The process of claim 1 wherein the second post heat treatment has at least three heating stages.

11. The process of claim 2 wherein the stretched filaments are held at constant length during the second post heat treatment, the second post heat treatment has at least three heating stages, $\Sigma E$ is at least 4.0, and the total time ($\rho t$) for all the heating stages is from about 1 hour 25 minutes to about 4 hours.

* * * * *

UNITED STATES PATENT OFFICE

CERTIFICATE OF CORRECTION

Patent No. 4,026,973 Dated May 31, 1977

Inventor(s) Takeo Shima et al.

It is certified that error appears in the above-identified patent and that said Letters Patent are hereby corrected as shown below:

Claim 1, line 5, delete "and" in the first instance and insert -- to --

Claim 11, line 5, delete "(pt)", insert -- (Σt) --

Signed and Sealed this thirtieth Day of August 1977

[SEAL]

Attest:

RUTH C. MASON
*Attesting Officer*

C. MARSHALL DANN
*Commissioner of Patents and Trademarks*